United States Patent [19]

Malm

[11] Patent Number: 4,510,356

[45] Date of Patent: Apr. 9, 1985

[54] LIQUID METAL SWITCH APPARATUS

[76] Inventor: John A. Malm, 19731 Frazier Dr., Rocky River, Ohio 44116

[21] Appl. No.: 537,952

[22] Filed: Sep. 30, 1983

[51] Int. Cl.[3] ..... H01H 31/00

[52] U.S. Cl. ..... 200/48 R; 200/82 B; 200/193; 374/143

[58] Field of Search ..... 374/143, 152, 500; 200/48 R, 82 B, 193, 203, 209, 210, 234, 235, 268, 199

[56] References Cited

U.S. PATENT DOCUMENTS

| | | | |
|---|---|---|---|
| 2,208,179 | 7/1940 | Colby | 200/209 |
| 2,862,073 | 11/1958 | Brutscher, Sr. et al. | 200/199 |
| 3,356,798 | 12/1967 | McKinnon | 200/48 R |
| 3,369,094 | 2/1968 | Langberg et al. | 200/199 |
| 3,379,846 | 4/1968 | Wood et al. | 200/268 |
| 3,700,840 | 10/1972 | Wilson et al. | 200/48 R |
| 3,778,680 | 12/1973 | Vaneerden | 317/100 |
| 3,801,768 | 4/1974 | Meyer | 200/48 R |

FOREIGN PATENT DOCUMENTS

| | | | |
|---|---|---|---|
| 133880 | 10/1919 | United Kingdom | 200/210 |

OTHER PUBLICATIONS

The GEC Liquid Metal GAIN Switch.

*Primary Examiner*—Willis Little
*Attorney, Agent, or Firm*—Fay & Sharpe

[57] ABSTRACT

A movable high amperage electrical switching buggy which is adapted for use in a corrosive atmosphere includes a wheeled chassis and spaced apart first and second electrical terminals housed on the chassis and extending therefrom. First and second electrical conductors are positioned within the housing and communicate with the first and second terminals respectively. At least one high amperage electrical switch is housed on the chassis with respective terminals of the switch being in electrical contact with the respective electrical conductors. The switch includes a first switch terminal including a piston chamber and a movable piston contact member housed therein and a second switch terminal. An insulating member is secured between the first switch terminal and the second switch terminal to prevent electrical contact therebetween unless the piston is in contact with the second terminal. At least one sliding contact current transfer member is positioned on the movable piston member to continuously maintain contact between the piston member and the first switch terminal. An actuator mechanism is also provided to selectively actuate the movable piston to establish electrical contact between the terminals.

22 Claims, 9 Drawing Figures

LIQUID METAL SWITCH APPARATUS

BACKGROUND AND SUMMARY OF THE INVENTION

The present invention relates generally to novel high amperage electrical switching or shunting apparatus. More particularly, the present invention concerns a liquid metal switch which is especially adapted for placement in a switching buggy used in a corrosive atmosphere of the type commonly found in close proximity to electrolytic cells used in the production of chlorine and caustic.

Chlorine and caustic are most commonly produced by the electrolysis of brine. The constructional features of the specific apparatus employed for this purpose vary, however, all such apparatus share the common feature that they require the usage of electric current. The vast majority of chlorine and caustic manufactured today is produced by the use of either the so-called diaphragm cell or the so-called mercury cell. In practice, a plurality of cells of a given type, often as many as a hundred or more, are usually located in a confined area, called a cell room, and are electrically connected in series. The resultant electrical arrangement of cells is commonly referred to as a circuit.

From a commercial standpoint, it is desired to operate the cell circuit in a continuous and uninterrupted manner. This means that when an individual cell in the circuit begins to exhibit undesirable operational characteristics, it must be repaired or removed from the circuit. In order to accomplish this while at the same time continuing the uninterrupted operation of the circuit, it is common practice to shunt the current around the affected cell while it is removed from the circuit for repair.

It has been common practice with low amperage electrolytic cells, i.e., those operating at about twenty to thirty thousand amperes, to employ an air cooled shunt or switch for the switching of the circuit around the affected cell. However, the recent trend in chlorine and caustic production has seen the introduction of new cell designs which are capable of operating at much higher amperage levels. Conventional air-cooled shunts and switches do not perform satisfactorily when used to shunt such high currents and therefore a new design has been necessitated.

A conventional liquid metal switch which has been developed for such higher amperage applications includes a sealed capsule in which a contact area is established between two fixed contact surfaces via a moving piston-shaped bridge contact. The bridge contact is electrically connected to a lower terminal only via a gallium-indium-tin liquid metal alloy for full current transfer. The bridge contact may be selectively electrically connected to an upper terminal contact member via the liquid metal such that at least a majority of the electrical current transfer is established through the liquid metal. It is a disadvantage of this type of liquid metal switch that the liquid metal used, i.e., gallium-indium-tin freezes at 11° C. It is therefore frequently necessary to heat the switch before operating it. An electric cartridge type heater is provided with the switch to enable such heating to occur. Moreover, it is also a disadvantage of the known switch that the full current transfer between the bridge contact and the lower contact terminal takes place through the liquid metal since if the liquid metal drains from the switch the bridge contact will no longer be electrically connected to the lower terminal.

It has, therefore, been considered desirable to develop a new and improved liquid metal switch for use in electrolytic cell shorting applications, which would overcome the foregoing difficulties while providing better and more advantageous overall results.

A high amperage electrical switch according to the present invention includes a first terminal member including a piston chamber and a movable piston contact member located therein and a second terminal member. An insulating member is secured between the first terminal and the second terminal to prevent electrical contact therebetween unless the piston is in electrical contact with the second terminal member. At least one sliding contact current transfer means is provided on the movable piston member to continuously maintain a sliding contact between the piston assembly and the first terminal member. Actuating means are further provided for selectively moving the movable piston to establish electrical contact between said first and second terminal members.

A movable high amperage electrical switching apparatus adapted for use in a corrosive atmosphere according to the present invention includes a carrier housing assembly containing thereon spaced apart first and second electrical terminals. Electrical conducting means are positioned within the housing for selectively communicating with the first and second electrical terminals. At least one high amperage switch is provided on the chassis in contact with the conducting means. The switch includes a first switch terminal having a piston chamber and a movable piston contact member housed therein and a second switch terminal. The movable piston contact member is in continuous electrical contact with the first switch terminal and may be selectively actuated into electrical contact with the second switch terminal by the actuating means.

The principal focus of the present invention is the provision of an improved liquid metal switch assembly. An advantage of the invention is the provision of a switch assembly which is usable at all commonly encountered temperatures.

Another advantage of the invention is the provision of a switch assembly in which the contact piston is continuously maintained in electrical contact with its terminal by sliding contact current transfer means.

An additional advantage of the present invention is the provision of a series of such switches in a switch buggy.

Yet other advantages of the present invention will become apparent to those skilled in the art upon a reading and understanding of the following detailed description.

BRIEF DESCRIPTION OF THE DRAWINGS

The invention may take form in certain parts and arrangements of parts, preferred embodiments of which will be described in detail in the specification, and wherein.

DESCRIPTION OF THE PREFERRED EMBODIMENTS

Figure 1:
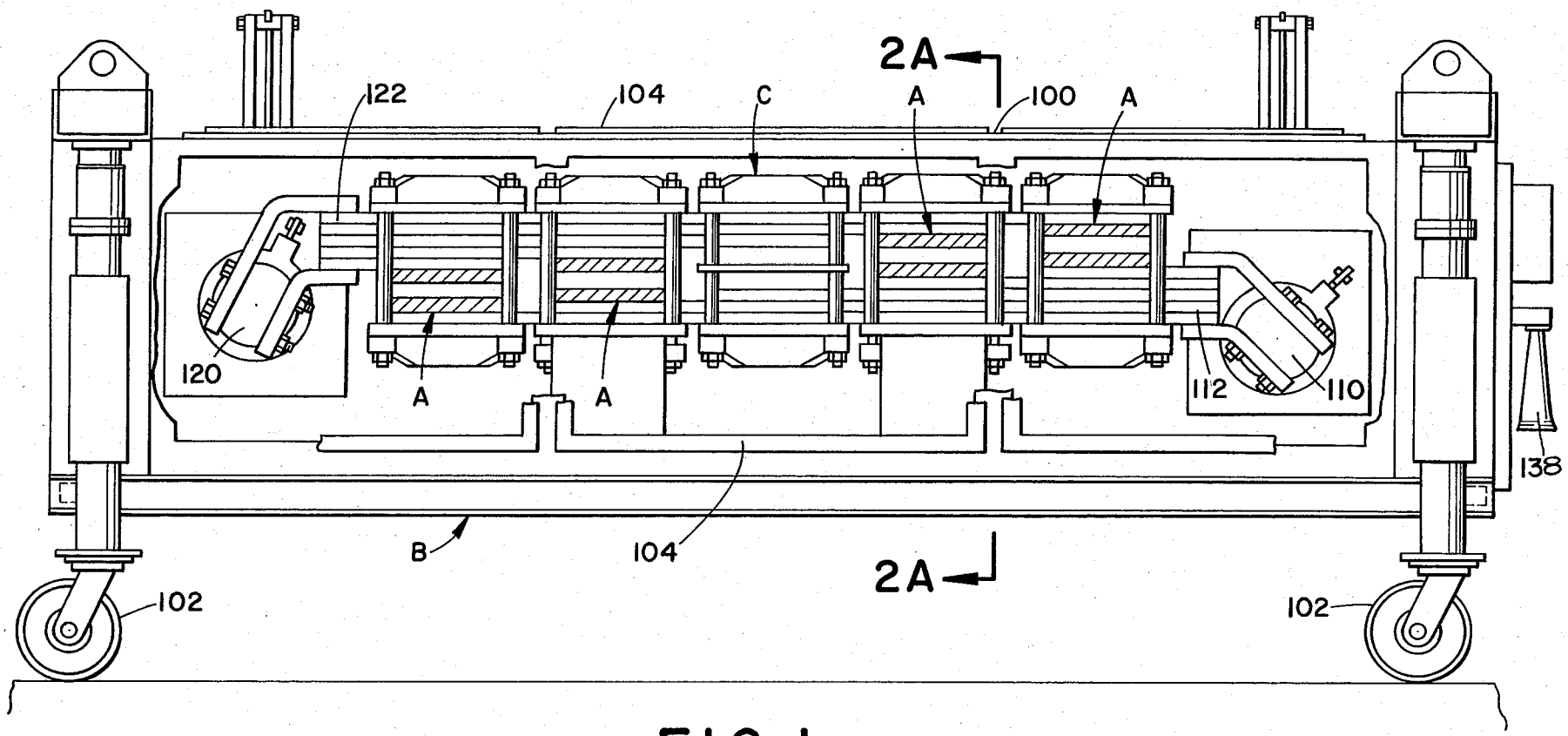
FIG. 1 is a front elevational view in partial cutaway of a switching buggy according to the present invention.

With reference to the drawings, wherein the showings are for purposes of illustrating the preferred embodiments of the invention only and not for purposes of limiting the same, FIG. 1 shows four switch assemblies A mounted in a switching buggy B according to the present invention. Each switch assembly A is mounted in a switch harness C (see also FIG. 2A) with the center switch harness standing empty. Each switch assembly A may be capable of handling 37,500 amperes so that the switching buggy B can handle 150,000 amperes in total. Of course, a greater or lesser number of switching assemblies A may be used as circumstances warrant. The switching buggy B is particularly useful in a circuit of electrolytic cells used for the production of chlorine or caustic.

The switching buggy B has a chassis 100 which may be mounted on a plurality of wheels 102 so that the buggy can be easily transported. A first electrical terminal 110 is mounted near one end of the buggy B with a second electrical terminal 120 being mounted near the other end of the buggy. Electrical conducting means in the form of five lower bus bars 112 are provided in electrical contact with the first electrical terminal 110 and five upper bus bars 122 are provided in electrical contact with a second electrical terminal 120. The bus bars 112, 122 are preferably made of copper or another suitable electrical conductor. Naturally, a larger or smaller number of bus bars may be provided if it is determined that a different amperage is to be conducted and/or if a different number of switch assemblies A are used. The buggy chassis 100 is sealed against the corrosive environment by a plurality of windows or other wall members 104.

Figure 2:
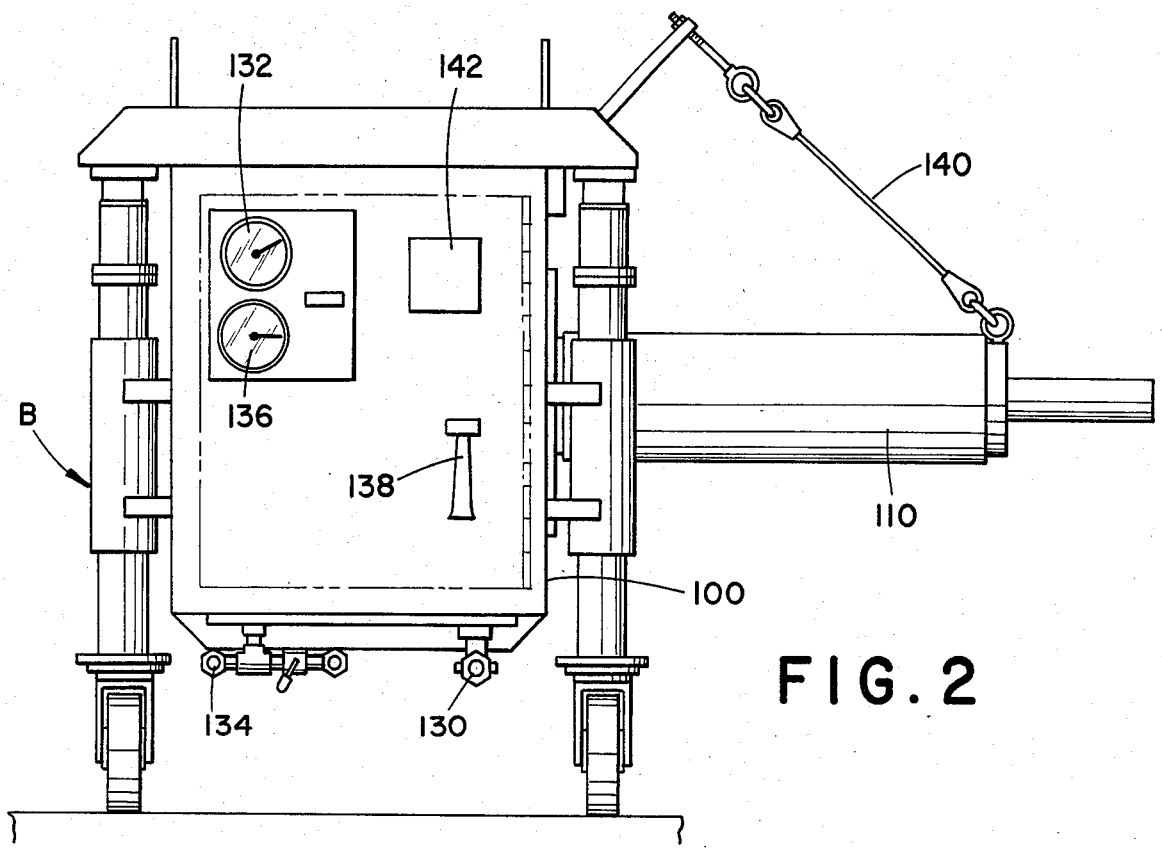
FIG. 2 is a side elevational view of the switching buggy of FIG. 1.

With reference now to FIG. 2, the switch assemblies A are cooled by cooling means of which an inlet duct 130 is visible on the buggy B. The cooling means may be a fluid coolant such as water. A pressure gauge 132 for monitoring the fluid coolant pressure is provided on the buggy B. Pressurization means are also provided, of which an inlet duct 134 is visible on the buggy B, to keep out the corrosive caustic or chlorine atmosphere in which the buggy is normally positioned and thereby preserve the switch assemblies A. Such pressurization means, which may be pressurized air, will provide an over-pressure in the buggy B somewhat above the ambient pressure to keep out the corrosive environment. A pressure gauge 136 for monitoring the air pressure is also provided on the buggy B. An alarm 138 is sounded by conventional sensors of the cooling means (not visible in FIG. 2) when the temperature of the switching assemblies A exceeds a predetermined temperature, which, for example, may be 175° F. The first and second terminals 110, 120 (of which only the first terminal is visible in FIG. 2) may extend away from the buggy B and be each supported by a sling assembly 140 mounted on the buggy (one sling assembly being visible in FIG. 2).

Figure 2A:
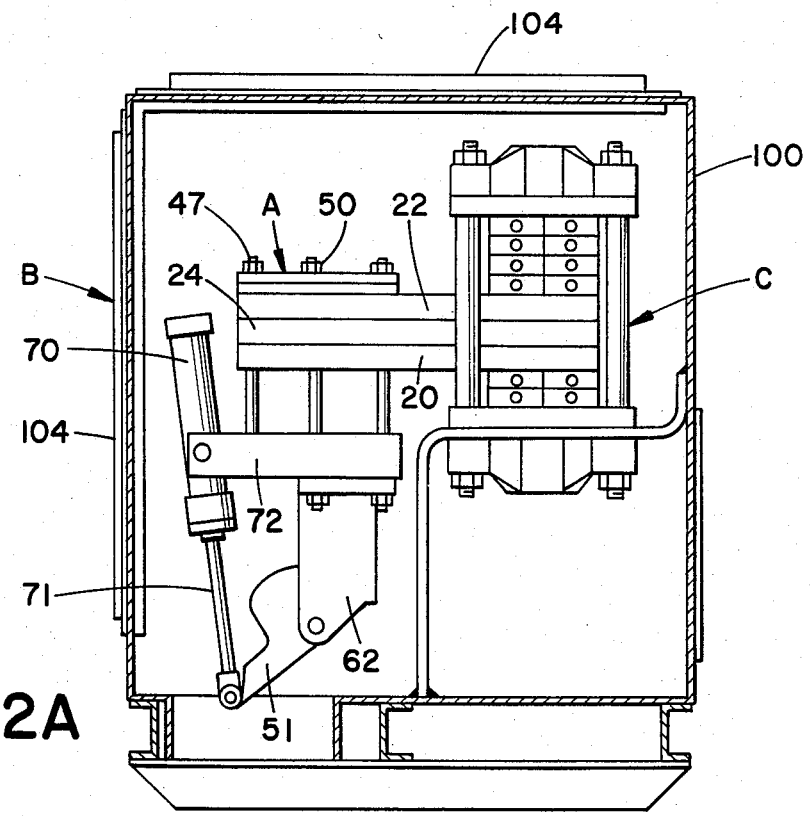
FIG. 2A is a cross-sectional view of the switching buggy of FIG. 1 along line 2A—2A.

With reference to FIG. 2A, the mounting of one of the switch assemblies A in a switch harness C of the buggy B is shown. Access panels 104 are provided on the top and sides of the buggy chassis 100 for ease of access to the switch assemblies A.

Figure 3:
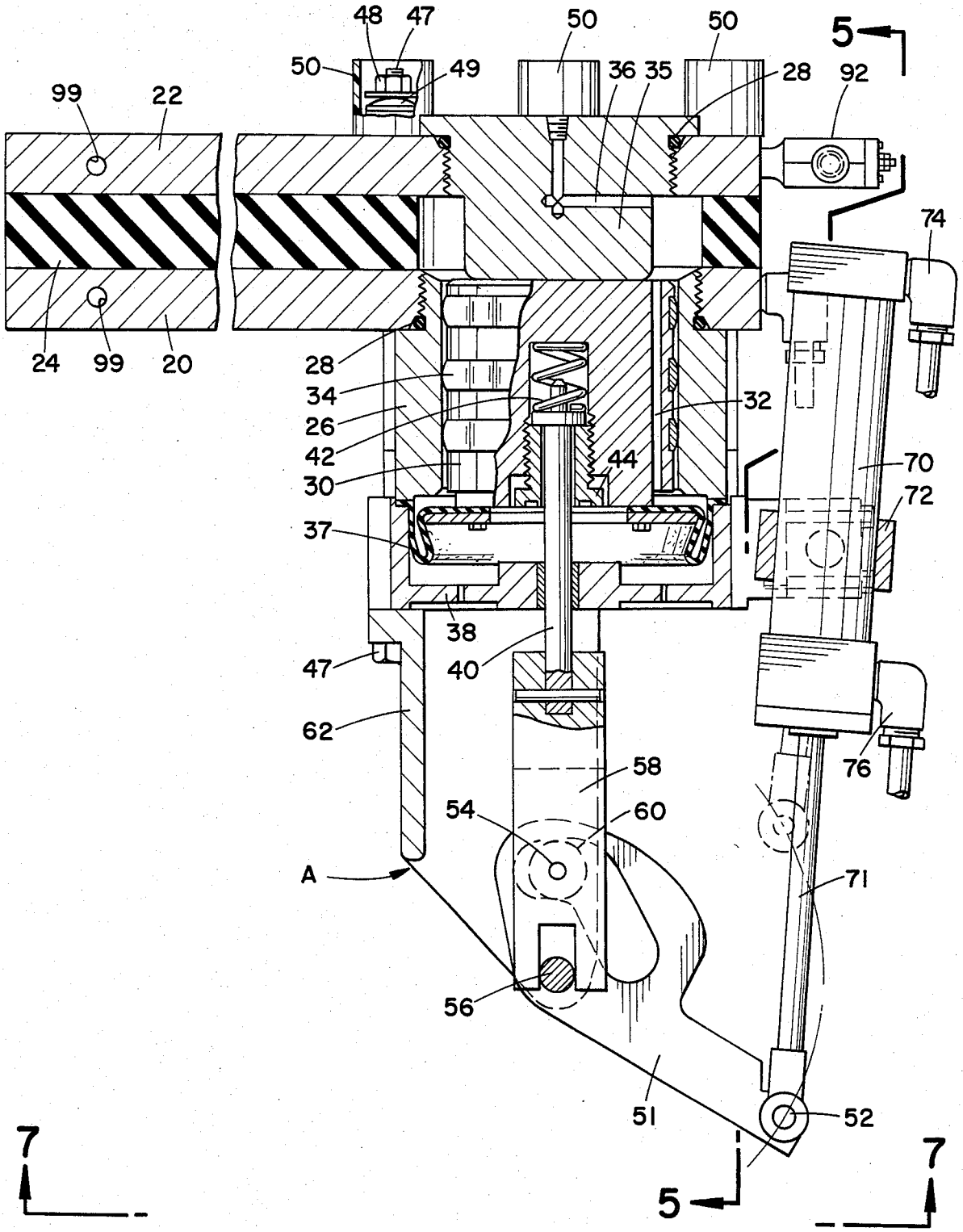
FIG. 3 is a cross-sectional view of a switch assembly according to the present invention.

With reference now also to FIG. 3, each liquid metal switch assembly A according to the present invention includes a first terminal 20 and a second terminal 22. The first switch terminal 20 is in electrical contact with the first buggy electrical terminal 110 and the second switch terminal 22 is in contact with the second buggy electrical terminal 120 through respective bus bars 112, 122. A layer of insulation 24 is provided between the two switch terminals 20, 22 to maintain their electrical isolation from each other. The first terminal, or anode, 20 is at a negative potential while the second terminal, or cathode, 22 is at a positive potential.

Figure 6A:
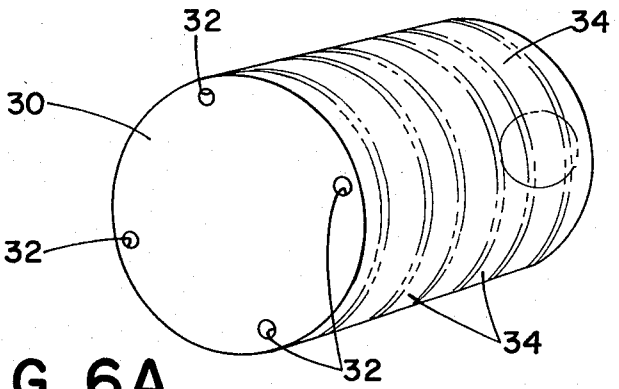
FIG. 6A is a perspective view of the contact piston of FIG. 4.
Figure 6B:
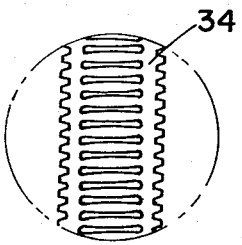
FIG. 6B is an enlarged view of a portion of a contact band on the piston of FIG. 6A; and, FIG. 7 is a plan view of the switch assembly of FIG. 3 along line 7—7.

Secured to the first terminal 20 is a piston cylinder 26. The piston cylinder 26 may be threaded into the first terminal 20 in a conventional manner with an O-ring 28 being provided to insure fluid tightness. A contact piston 30 is slideably contained in the piston cylinder 26. Extending longitudinally through the contact piston 30 are a plurality of apertures 32 which allow a liquid metal to flow back and forth in the cylinder 26 as the contact piston is actuated in a piston chamber partially defined by the cylinder 26. Preferably, four approximately one-quarter inch diameter apertures 32 are provided in the piston 30 although any other suitable number of apertures could also be used. The contact piston 30 is maintained in continuous electrical contact with the first terminal 20 by at least one sliding contact current transfer means such as a flexible louvered metallic band 34 provided around the exterior of the piston (see FIG. 6B). Three contact bands 34 are preferably provided on the piston 30 (see FIG. 6A) to keep the piston in electrical contact with the piston cylinder 26. The piston cylinder 26 in turn, is in electrical contact with the first switch terminal 20 since, as mentioned, it is preferably threaded therein. The piston cylinder 28 may, alternatively, be engaged in or secured to the first terminal 20 in any other conventional manner to maintain electrical contact between these two members.

The second terminal 22 may have extending therefrom a male plug contact member 35. This plug 35 may be threadably secured in the second terminal 22 although any other conventional method of securing such a plug in the terminal would also be adequate.

The male plug 35 is provided with an aperture 36 through which the ambient air inside the piston cylinder 26 in the switch may be bled away to be replaced with an inert gas, such as one of the noble gases, preferably argon. The inert gas is heavier than the oxygen component of the ambient air and keeps gases that support combustion out of the interior of the switch. After the replacement of the ambient air with the inert gas, the switch is sealed by a conventional cap or plug (not illustrated) in the aperture 36. It is anticipated that once the switch is sealed up, it will not be serviced for the life of the switch which is expected to be approximately four years or more.

A bellows assembly 37 is provided at the lower end of the contact piston 30 to prevent the liquid metal from running out of the piston chamber defined by the piston cylinder 26 and the second terminal 22 including the male contact plug member 35. The bellows assembly 37 is positioned in a bellows housing 38 through a center portion of which a piston rod 40 extends to actuate the contact piston 30. A spring 42 is provided within the contact piston 30 and resiliently engages the piston rod 40. A spring tension nut 44 is provided on the piston rod 40 to enable tension changes to be made in the spring 42 as desired.

Figure 4:
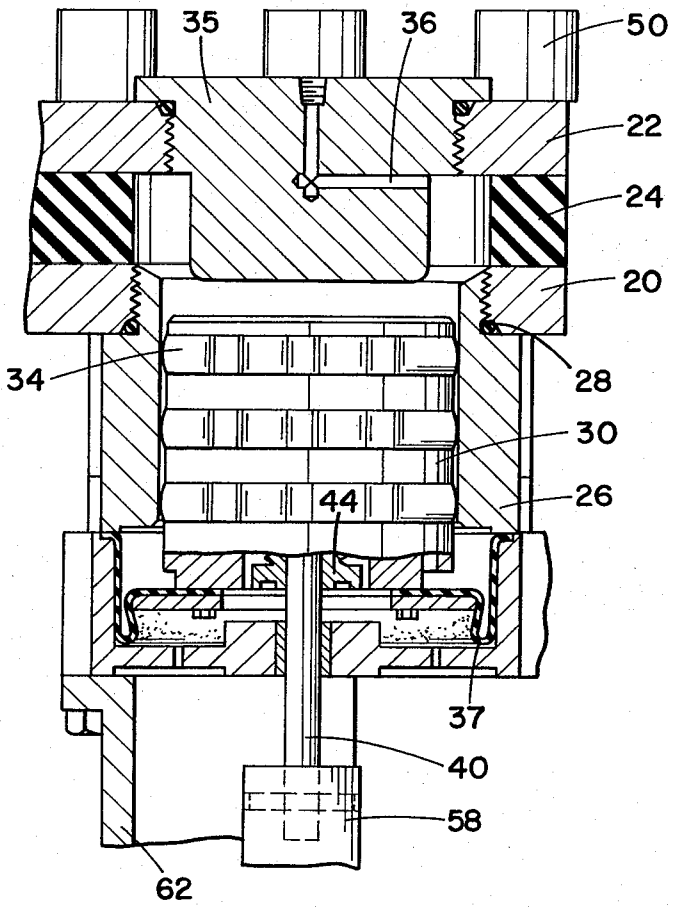
FIG. 4 is a cross-sectional view of a portion of the switch of FIG. 3 with a contact piston being spaced away from a male contact plug.

The contact piston 30 also acts like a pump and when actuated towards the plug 35 will pump the liquid metal, which is preferably mercury, so that it engulfs the plug 35 and establishes an electrical contact between the piston and the plug. When the piston 30 is actuated away from the plug 35 (see FIG. 4) the mercury is allowed to drain away to a level at approximately the top ends of the orifices 32 in the piston. In the open state of the switch A, a gap of approximately one-half inch will be maintained between the piston 30 and the plug 35. The mercury is hermetically housed in the switch to prevent environmental contamination. The use of mercury as the liquid metal is advantageous because mercury has a freezing temperature of approximately −39° F.

In order to allow the amalgamation of the mercury liquid metal to the piston 30 and the plug 35 as well as the first and second terminals 20, 22, which are preferably all made from copper or a copper alloy, the portions of these components located in the piston chamber may be metal plated, for example with a silver plating. Of course any other highly conductive metal could also be used for the plating. In other words, all the copper components of the piston chamber 26, in which the mercury is housed are preferably plated.

The two terminals 20, 22 and the insulation layer 24 therebetween are secured to each other by a plurality of bolts 47 which are tightened by hex nuts 48 operating against belleville washers 49. The top portion of the securing apparatus is housed in an insulator tube 50 which extends into the insulation layer 24. Thus the bolts 47 and the associated nex nuts 48 and belleville washers 49 are held at the anode potential. The insulator tube 50 may be of a nylon or delron plastic material while the insulation layer 24 may be made of fiberglass. Of course any other suitable insulation material may be used for the insulator tube 50 and the insulation layer 24.

In order to move the contact piston 30, a camming assembly is used. The camming assembly includes a cam plate 51 which pivots around a pivot pin 52 and a roller pin 54. A cam pin 56 is provided on the cam plate 51 in sliding engagement with a female rod clevis 58 to which is attached the roller pin 54 and a roller bearing 60 surrounding the roller pin. A frame 62 holds the camming assembly.

The piston rod 40 is not insulated so that all the components of the camming assembly are at the anode potential. As mentioned, the bolts or tie rods 47 are also at this potential and are insulated from the cathode by the insulating tubes or cups 50.

A switch actuating cylinder 70, which may be an air cylinder, actuates a piston rod 71 to operate the camming assembly. The cylinder 70 is mounted adjacent to the switch by a mounting means 72. A gas inlet port 74 and a gas outlet port 76 are provided on the cylinder 70 so that an actuating gas may be supplied to move the piston rod 71 and actuate the cam 51 as desired. A control valve means 142 (see FIG. 2) such as a conventional four-way actuating valve may be used to control the actuation of the cylinder 70 and hence the switch.

The spring 42 allows the set of over-travel in the camming assembly to go over center by approximately two degrees. In this way, even if air pressure should be lost in the switch actuating cylinder 70, the contact between the piston 30 and the plug 35 will still be maintained. Approximately three thirty seconds inches of over-travel is provided so that the camming assembly drifts back a little in order that it is over center and thus locked. The switch A thus does not pop open if air pressure is lost. The switch buggy is also provided with a high pressure gas cylinder (not illustrated) or similar pressurized fluid source for actuating each of the switch actuating cylinders 70. As mentioned, the control valve means 142 is provided on the buggy B (see FIG. 2) to control the flow of pressurized fluid from the gas cylinder to each of the switch actuating cylinders 70.

Figure 5:
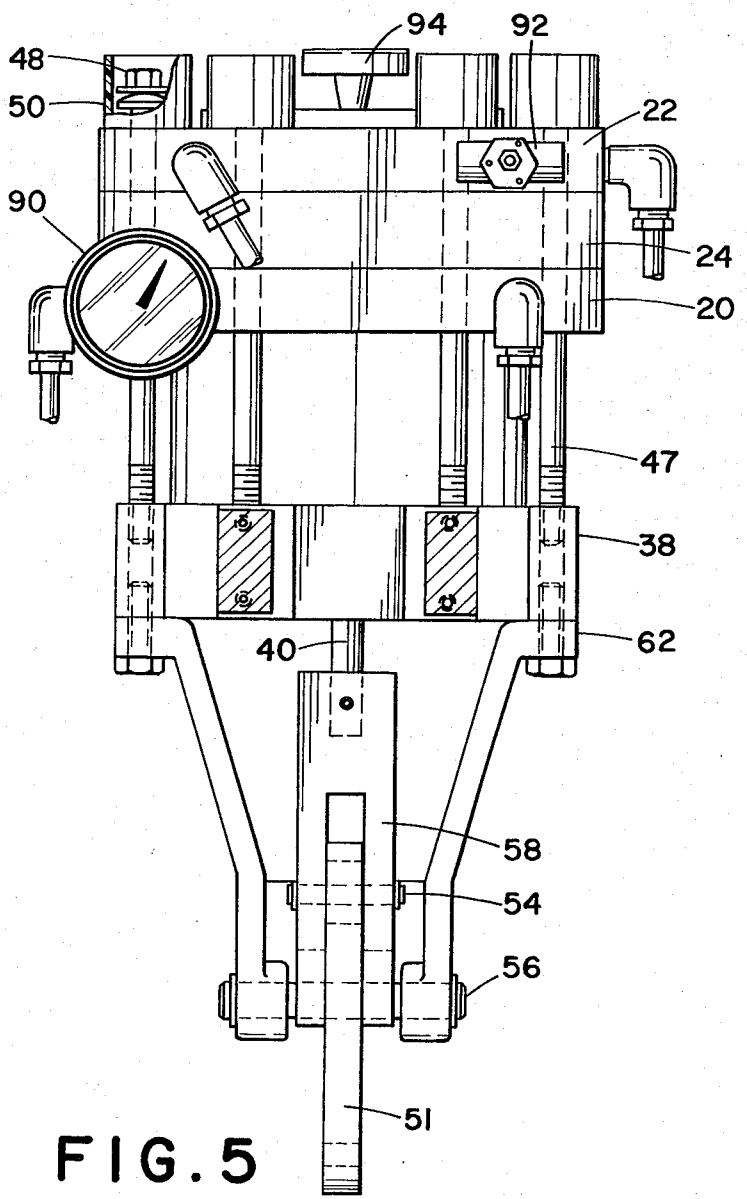
FIG. 5 is a cross-sectional view of the switch assembly of FIG. 3 along line 5—5.

With reference now to FIG. 5, the switch assembly A also includes a dial thermometer 90 to measure the temperature of the switch assembly A and a temperature transmitter 92 which will pneumatically actuate the alarm or warning horn 138 (see FIG. 2) if too high a temperature is encountered. The warning horn 138 is actuated if the temperature of the switch assembly A rises above approximately 175° F. Further included on the switch assembly is a vacuum pressure gage 94 to measure the pressure in the piston cylinder space in the switch A.

Figure 7:
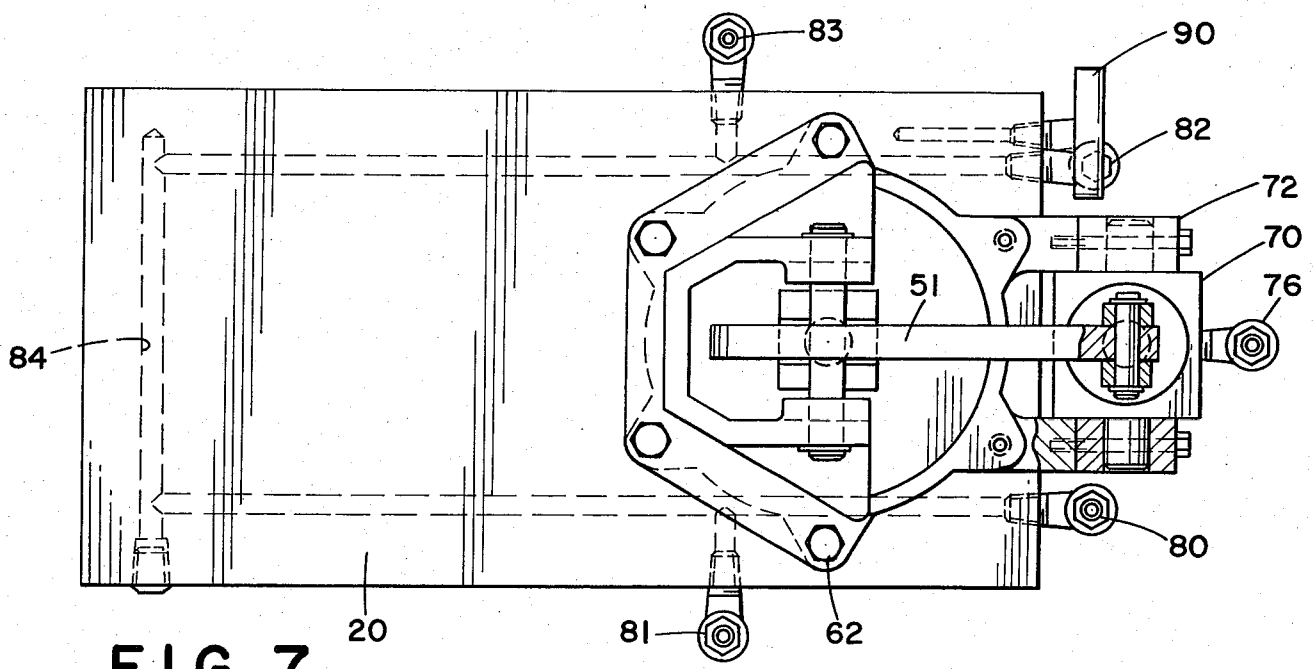

With reference now to FIG. 7, an inlet nozzle 80, 81 is provided for each of the terminals 20, 22 along with an outlet nozzle 82, 83. These nozzles 80, 81, 82, 83 are connected to the cooling means to allow a coolant fluid to flow through a set of channels 84 provided in each of the terminals 20, 22 (only the first terminal 20 being visible in FIG. 7).

When using the apparatus of the invention as shown in FIG. 3 in order to shunt electrical currents of high amperage around a cell taken out of the circuit the four switches are closed by actuating their respective camming assemblies to move the piston 30 into contact with the plug 35. With the switches closed, the electrical current is shunted around the non-operative cell so that the cell may be repaired or replaced as necessary. Accordingly, the subject invention permits an electrolytic cell to be shunted out of the circuit most expeditiously while insuring that the circuit of all the operating cells can continue to function.

Although the invention has been shown and described with reference to a preferred embodiment, it is obvious that alterations and modifications will occur to others upon a reading and understanding of this specification. The invention includes all such alterations and modifications insofar as they come within the scope of the claims or the equivalents thereof.

What is claimed is:

1. A high amperage electrical switching apparatus comprising:

a first terminal member including a piston chamber and a movable piston contact member housed therein;

a second terminal member;

an insulating member secured between said first terminal and said second terminal to prevent electrical contact therebetween unless said piston is in electrical contact with said second terminal member;

at least one sliding contact current transfer means provided on said movable piston member for continuously maintaining contact between said piston member and said first terminal member; and actuating means for selectively actuating said movable piston to establish electrical contact between said first and second terminal members.

2. The apparatus of claim 1 further comprising a liquid metal current transfer medium disposed between said second terminal member and said piston to enhance the electrical contact therebetween, said liquid metal being hermetically housed in the apparatus to prevent environmental contamination.

3. The apparatus of claim 2 wherein said liquid metal has a freezing point below 0° C.

4. The apparatus of claim 2 wherein said liquid metal remains in a liquid state to at least −35° C.

5. The apparatus of claim 4 wherein said liquid metal is mercury.

6. The apparatus of claim 1 wherein said actuating means includes an actuating piston, a cam assembly controlled by said actuating piston and a piston rod secured to said movable piston contact member.

7. The apparatus of claim 2 further including a bellows assembly secured to a rear surface of said piston, opposite a front surface which can contact said second terminal member, to retain said liquid metal in said piston chamber.

8. The apparatus of claim 7 wherein said piston contains at least one bore through which said liquid metal is able to flow between said bellows assembly and said contact piston front surface as said contact piston is actuated.

9. The apparatus of claim 1 further comprising instrument means for determining the temperatures and pressures in the apparatus.

10. The apparatus of claim 9 wherein said instrument means includes a temperature measuring device which sounds a warning when the temperature in the device exceeds a predetermined limit.

11. The apparatus of claim 1 wherein said second terminal member includes a male plug member.

12. The apparatus of claim 11 wherein said piston and said male plug as well as said first and second terminals are made of copper and are silver coated to allow a mercury liquid metal current transfer medium from amalgamating to said copper.

13. The apparatus of claim 1 wherein the switch is filled with an inert gas to retard combustion in the switch.

14. The apparatus of claim 1 wherein said sliding current transfer means includes a metallic band encircling said movable piston member.

15. A movable high amperage electrical switching buggy adapted for use in a corrosive atmosphere, comprising:

a chassis;

spaced apart first and second electrical terminals housed on said chassis;

electrical conducting means positioned within said housing for communicating with said first and second terminals; and at least one high amperage electrical switch housed on said chassis and in electrical contact with said electrical conducting means, said switching assembly including a first terminal member having a piston chamber and a movable piston contact member housed therein, and a second terminal member, an insulating member secured between said first and second terminals to prevent electrical contact therebetween when said switch is in the open position, said piston being in continuous electrical contact with said first terminal member and being actuated into selective electrical contact with said second terminal member by actuating means.

16. The apparatus of claim 15 further comprising cooling means for cooling said at least one high amperage switching assembly.

17. The apparatus of claim 15 further comprising pressurization means for maintaining a pressurized atmosphere within said housing at least slightly in excess of ambient pressure to prevent corrosive vapors from entering said housing.

18. The apparatus of claim 16 further including sensing and warning means to sense the temperature in said at least one high amperage switching assembly and to sound an alarm if the temperature exceeds a predetermined upper limit.

19. The apparatus of claim 15 wherein four switching assemblies are provided to enable the switching buggy to be used for high amperage applications.

20. The apparatus of claim 16 wherein said cooling means includes fluid channels provided in said first and second switch terminals, said fluid channels being in fluid contact with a pressurized cooling fluid source to enable a cooling fluid to flow through said channels and cool said switch terminals.

21. The apparatus of claim 15 wherein said second terminal member includes a male plug member which extends therefrom.

22. The apparatus of claim 15 further comprising a sliding contact current transfer band which encircles said movable piston contact member to continuously maintain electrical contact between said movable piston contact member and said first terminal member.

* * * * *